United States Patent [19]

Cervantes

[11] 4,372,605

[45] Feb. 8, 1983

[54] HAIRDRESSER CHAIR

[76] Inventor: Victoria Cervantes, 5538 Capellina Way, Santa Barbara, Calif. 93111

[21] Appl. No.: 193,655

[22] Filed: Oct. 3, 1980

[51] Int. Cl.[3] ..... A47C 7/62; A47C 1/04

[52] U.S. Cl. ..... 297/192; 297/188; 297/349; 297/417

[58] Field of Search ..... 297/192, 188, 182, 417, 297/411, 347, 349; 248/289.1; 108/139, 140; 403/92, 93, 96, 328

[56] References Cited

U.S. PATENT DOCUMENTS

| | | | |
|---|---|---|---|
| 361,906 | 4/1887 | Stiles | 297/192 |
| 401,003 | 4/1889 | Burns | 403/93 X |
| 2,700,949 | 2/1955 | Kunzi | 403/93 X |
| 2,821,240 | 1/1958 | Morrill, Jr. | 108/140 |
| 2,954,955 | 10/1960 | Feller | 297/188 X |
| 3,311,411 | 3/1967 | Page et al. | 108/140 X |
| 3,601,443 | 8/1971 | Jones | 297/188 |
| 3,712,669 | 1/1973 | Cates | 297/188 |
| 3,785,700 | 1/1974 | Kubo | 108/140 |
| 3,826,531 | 7/1974 | Page | 297/188 |
| 4,118,069 | 10/1978 | Hunter | 297/417 X |
| 4,136,908 | 1/1979 | Crayne | 297/188 |

*Primary Examiner*—James T. McCall
*Attorney, Agent, or Firm*—Jack C. Munro

[57] ABSTRACT

A chair to be used by a hairdresser while performing hairdressing duties on a customer. The hair is to include a conventional seat and back and also conventional arms attached and extending from the back. Each arm is to be movable to a retracted position. A tray assembly is attached to the chair and is to be movable in various positions in respect thereto. The seat of the chair is to be raised and lowered to be movable to different heights. The tray is to be movable between an extended/usable position to a retracted/stowed position. The entire chair is to be mounted upon rollers to facilitate movement about the floor.

2 Claims, 18 Drawing Figures

FIG. 5.
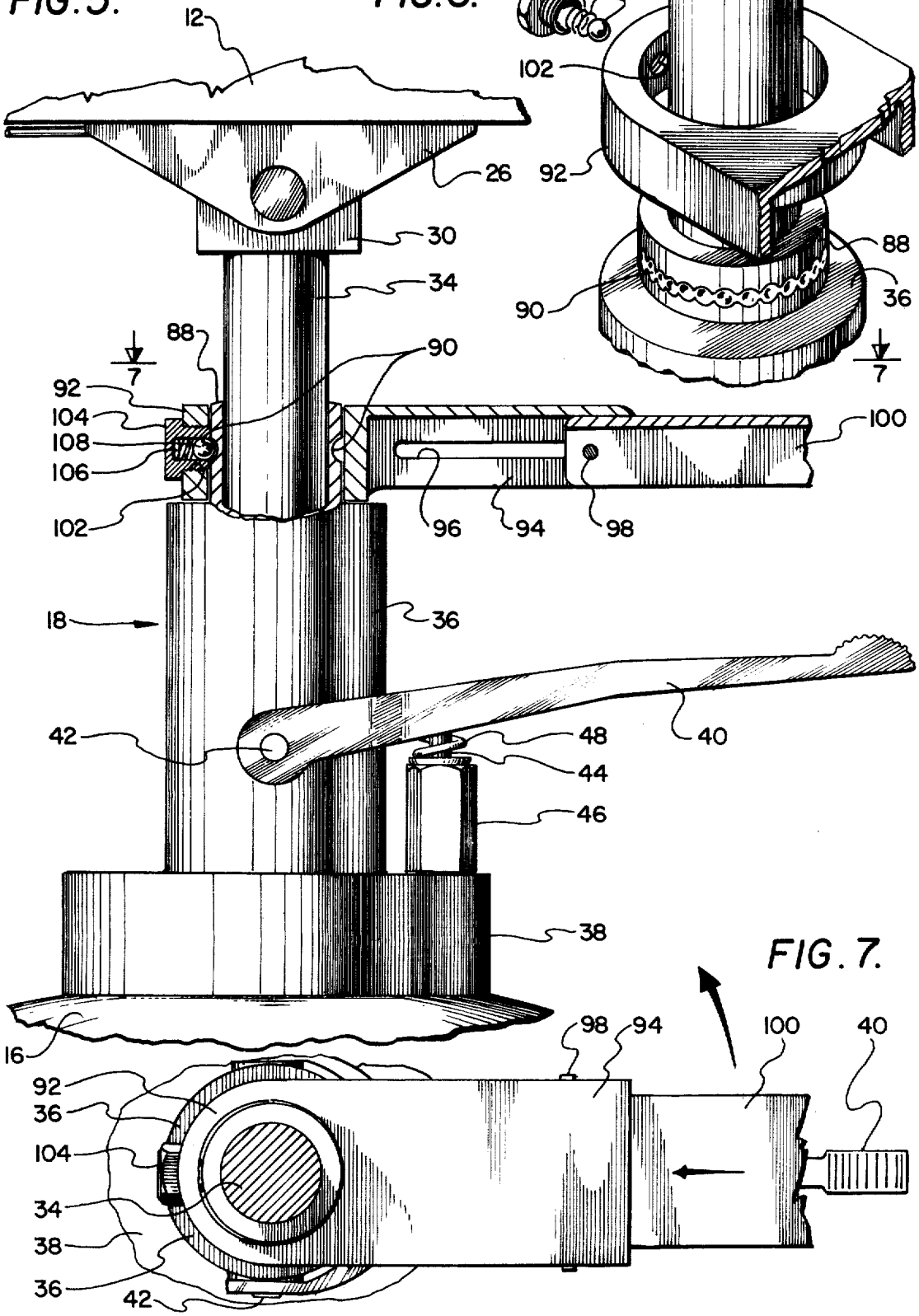
FIG. 6.
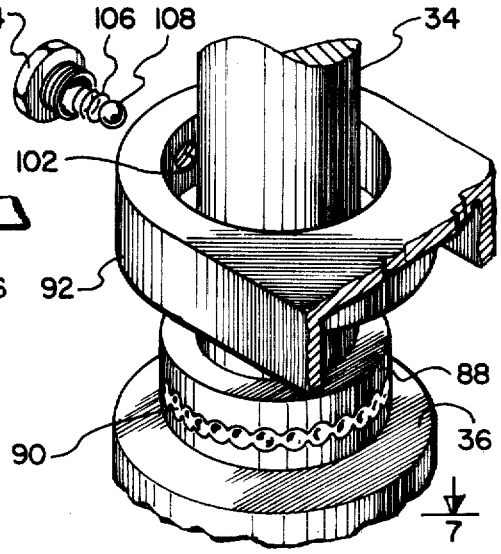
FIG. 7.

FIG. 13.
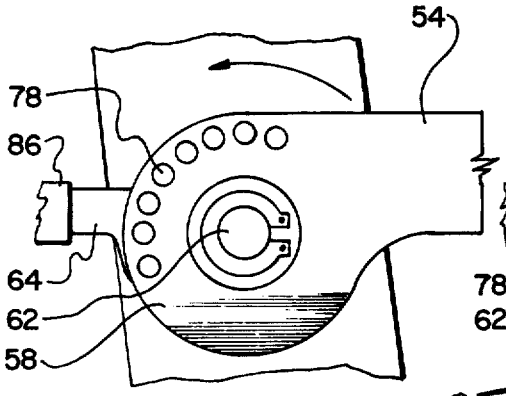
FIG. 14.
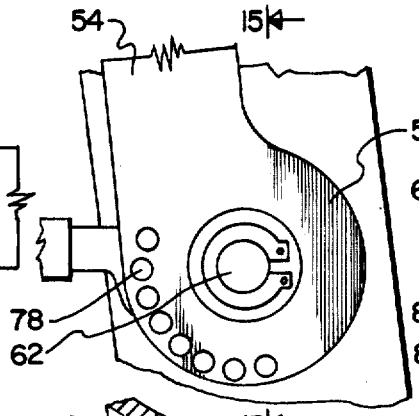
FIG. 15.
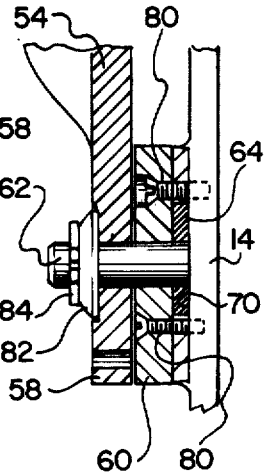
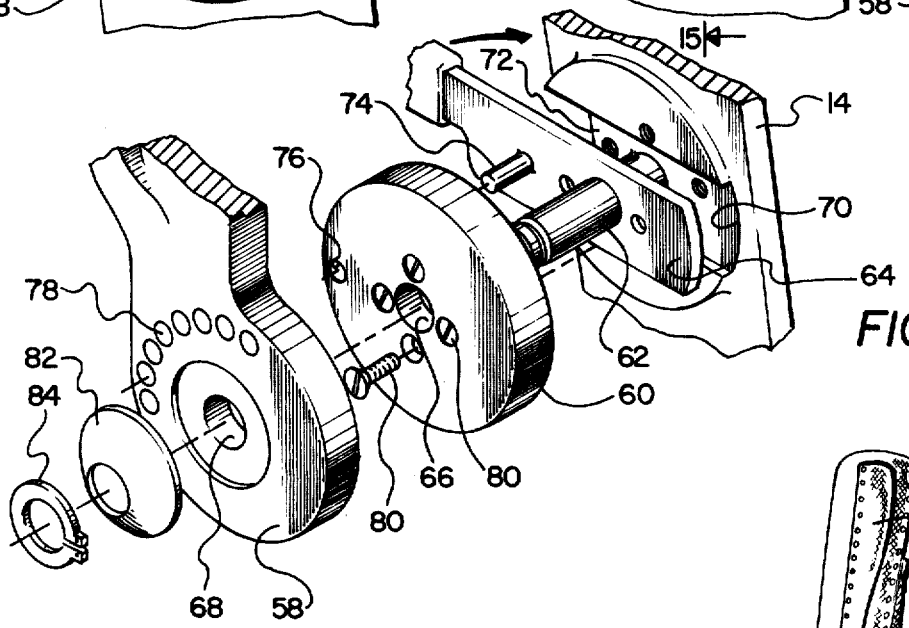
FIG. 16.
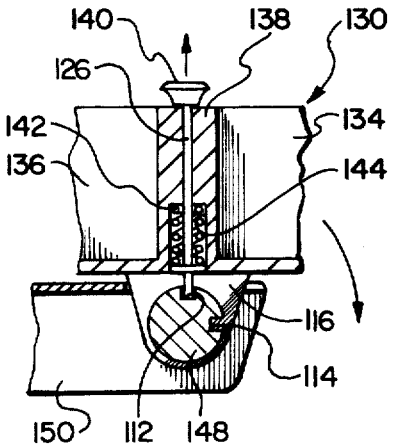
FIG. 17.
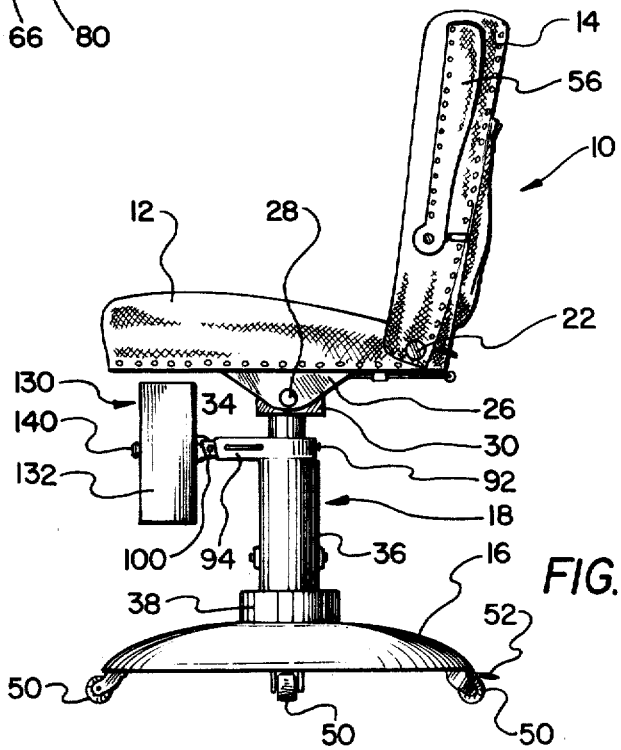
FIG. 18.

HAIRDRESSER CHAIR

BACKGROUND OF THE INVENTION

The field of this invention relates to chairs, and more particularly to a chair which has been specifically designed to be employed by a hairdresser during the performing of hairdressing duties upon a customer.

There have been several different types of chairs which have been specifically designed to be used by the customer of the hairdresser. The hairdresser is to normally stand and move about the customer during performance of the hairdressing duties. If there is to be provided some form of a seat for the hairdresser, it generally will be no more than a stool.

Hairdressers are constantly using hairdressing articles, such as hair rollers, hair pins, combs, brushes, and the like. Also, the hairdresser is required to work on the lower portion of the person's hair and also to do work on the upper portion of the person's hair. It would be desirable to design some type of a seating arrangement for the hairdresser in which the seat could be adjusted to different heights to facilitate hairdressing operations at the lower portion of the person's hair, as well as to the upper portions of the person's hair. Also, it would be convenient if the chair could include some form of a tray, wherein the tray could be movable to different desirable locations adjacent the customer. The purpose for the tray is to support hairdressing articles to facilitate their usage, eliminating the need for the hairdresser to have to secure a hairdressing article that is spaced some distance from the customer.

SUMMARY OF THE INVENTION

The hairdressing chair of this invention is designed to be used by the hairdresser and is to not only be comfortable to the hairdresser, but also to cause the hairdresser to become more efficient in the performance of hairdressing duties. The chair includes a base which is mounted on rollers to be readily movable upon the floor upon which it is located. An upright stanchion extends from the base, the free end of which is connected to a seat. The stanchion includes a hydraulic (or pneumatic) actuator for the purpose of vertically moving the seat to various positions. A tray assembly is attached to a telescoping arm assembly, which in turn is pivotally mounted onto the stanchion. The tray assembly is positioned adjacent the undersurface of a seat and is to be pivotally movable three hundred and sixty degrees about the stanchion and is to be setable in practically any angular position. The tray is also to be movable with respect to the telescoping arm assembly to a retracted stowable position. The tray may include drawers, wherein each drawer is pivotally mounted with respect to the tray. This tray is pivotable with respect to the telescoping arm assembly from an extended usable position to a retracted stowed position. In the retracted stowed position, the drawers are closed to thereby prevent accidental dislodgement of any articles contained within the drawers. Pivotally attached to the seat is a chair back. A pair of arms are pivotally mounted to the chair back. Each of the chair arms are movable from an extended usable position to a retracted stowed position along side of the chair back.

The primary objective of this invention is to construct a chair which is designed primarily for usage by hairdressers in the performing of the hairdressing duties upon a customer.

BRIEF DESCRIPTION OF THE DRAWINGS

FIG. 5 is an enlarged, partly in cross-sectional view of the stanchion assembly employed in conjunction with the hairdresser chair of this invention;

FIG. 6 is an exploded, partly cut-away, perspective view of the detent mechanism included within the stanchion assembly of the chair of this invention;

FIG. 7 is a partly in cross-sectional view taken along line 7—7 of FIG. 5;

FIG. 13 is an enlarged, side view of an arm assembly showing generally the connection of the arm to the back of the chair and showing the arm in the extended position;

FIG. 14 is a view similar to FIG. 13, but showing the arm in the retracted position;

FIG. 15 is a cross-sectional view taken along line 15—15 of FIG. 14;

FIG. 16 is an exploded, perspective view of the arm mechanism shown within FIG. 13;

FIG. 17 is a cross-sectional view through the locking knob assembly of the second embodiment of tray assembly of this invention; and FIG. 18 is a side view of the chair of this invention with the arms in the retracted position and the tray in the completely stowed position, with the tray assembly being of the second embodiment of tray assembly of this invention.

DETAILED DESCRIPTION OF THE SHOWN EMBODIMENTS

Figure 1:
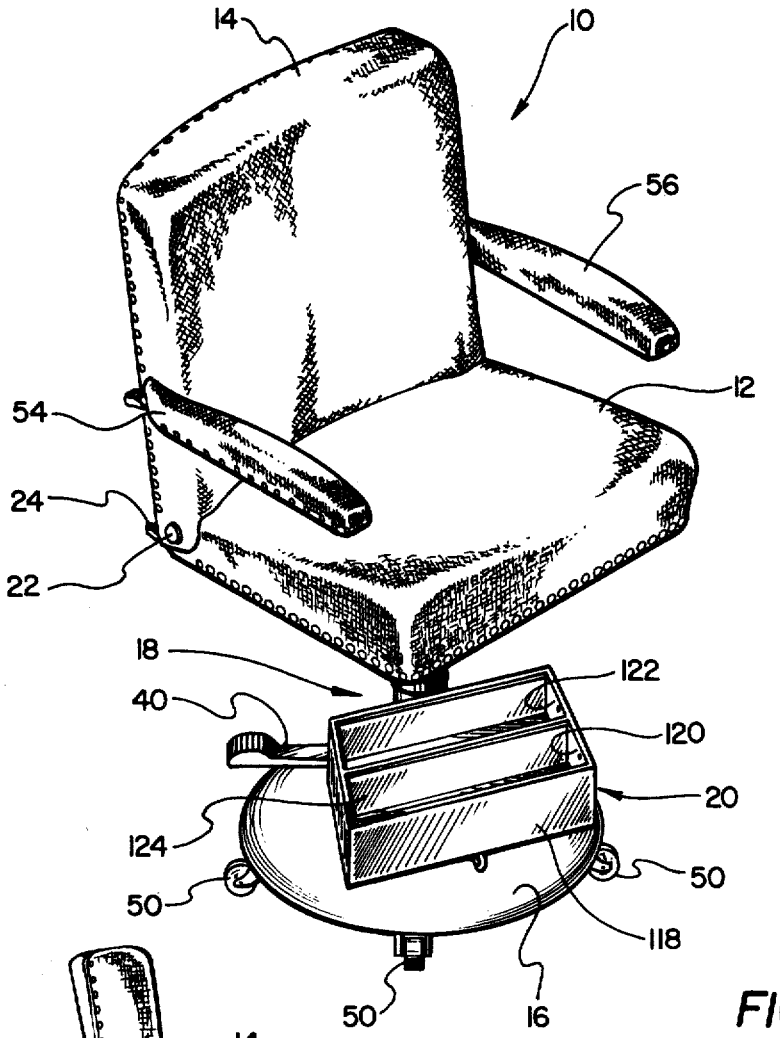
FIG. 1 is an overall, perspective view of the hairdresser chair of this invention.
Figure 2:
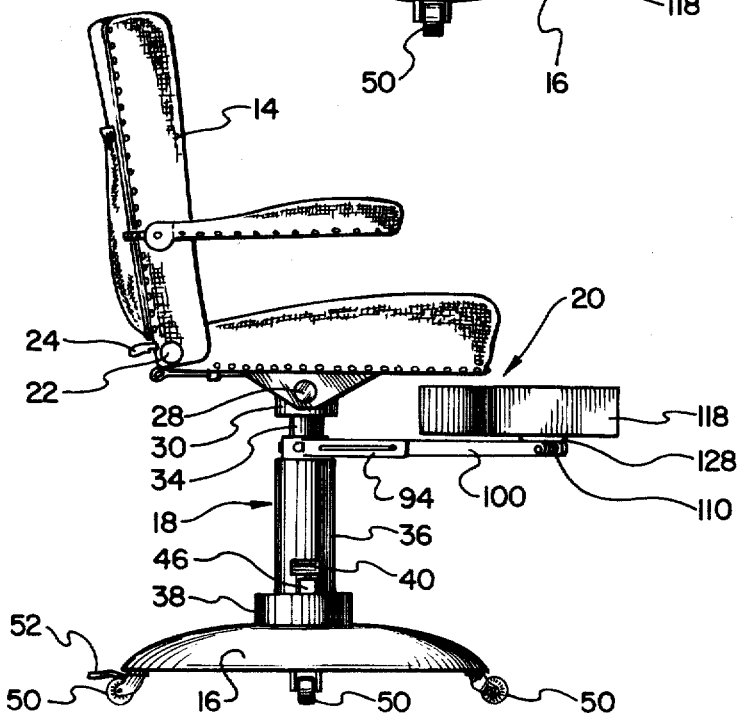
FIG. 2 is a side, elevational view of the hairdresser chair of this invention.
Figure 3:
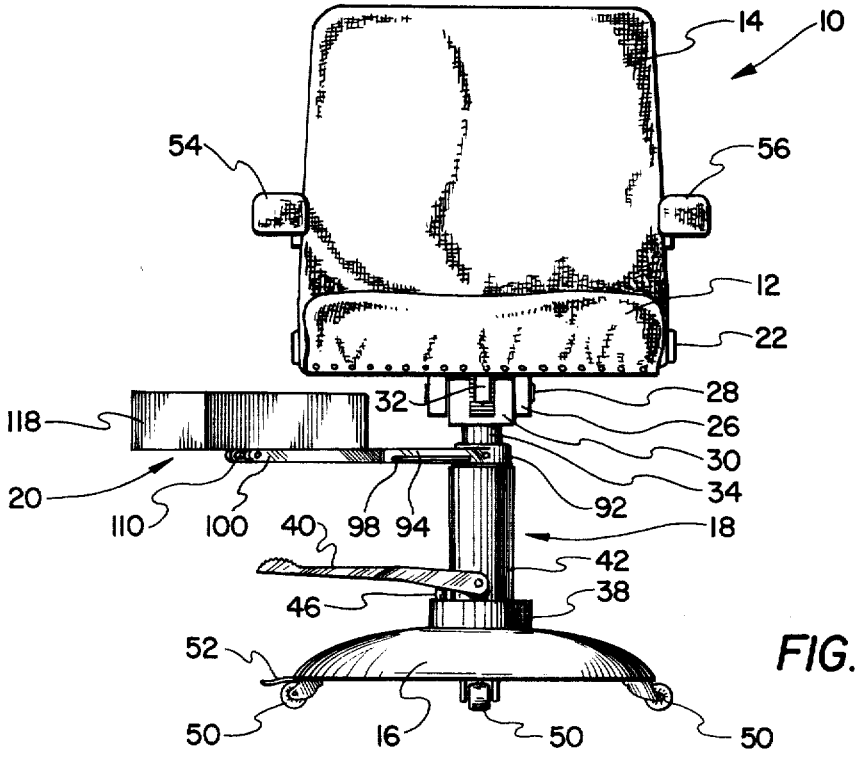
FIG. 3 is a front, elevational view of the hairdresser chair of this invention.
Figure 4:
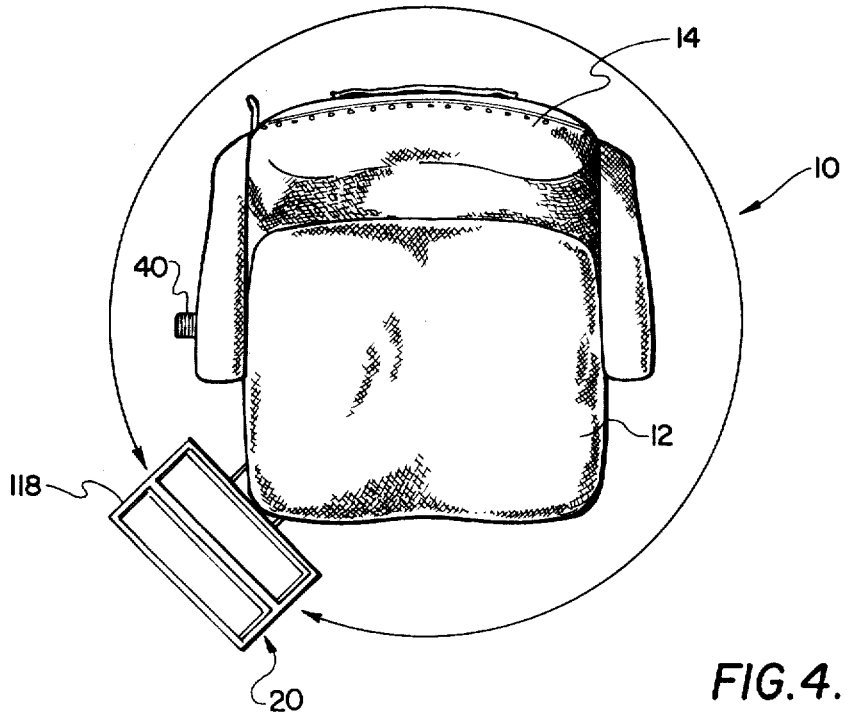
FIG. 4 is a top, plan view of the hairdresser chair of this invention.

Referring particularly the drawings, there is shown hairdresser chair 10 of this invention which is composed basically of a seat 12, a back 14, a base 16, a stanchion assembly 18 and a tray assembly 20. The back 14 is pivotally mounted with respect to the seat 12 by means of a pivot rod 22. The position of the back 14 is to be locked with respect to the pivot rod 22 by means of manually operated locking member 24.

Attached to the bottom surface of seat 12 is a bifurcated mounting bracket assembly 26. A pivot shaft 28 connects with the bracket assembly 26. The pivot shaft 28 extends through a block 30. Secured to the undersurface of the seat 12 is a spring biased locking pawl 32. This spring biased locking pawl 32 is to connect with a serrated surface on the block 30. The seat 12 is to be adjustable to various inclined positions in respect to the block 30 and once a particular position has been established, by manual release of the locking pawl 32, the seat 12 is maintained in the established adjusted position.

The block 30 is fixedly mounted on a piston rod 34 of the stanchion assembly 18. Piston rod 34 extends within a cylinder 36 of the stanchion assembly 18. Hydraulic fluid is to be located within the reservoir housing 38. The reservoir housing 38 is fixedly mounted on the base 16. The hydraulic fluid located within the reservoir housing 38 is to be pumped by actuation of lever 40 to move such within the interior chamber (not shown) of the cylinder 36.

The lever 40 is pivotally connected by a pin 42 to the exterior surface of the cylinder 36. A pump shaft 44 is moved vertically within a pump housing 46. A coil spring 48 surrounds the shaft 44 and is located between a lever 40 and the pump housing 46. By manual movement of the shaft 44, by foot pressure being applied against lever 40, the hydraulic fluid is moved from within the reservoir housing 38 to within the cylinder 36 which thereupon causes movement of the piston shaft 34. It is to be understood that an appropriate hydraulic fluid return valve will be employed when it is desired to lower the seat 12.

The bottom surface of the base 16 has mounted thereon a plurality of wheel caster assemblies 50. One or more of the caster assmblies 50 may include a locking mechanism 52 in order to fixedly position the base 16 upon the surface upon which it is located.

Connected to one side of the back 14 is an arm 54 with the second arm 56 being connected to the opposite side of the back 14. Each arm is connected in precisely the same manner with the same type of mechanism to the back 14. The mechanism comprises an outer plate 58 and an inner plate 60. A shaft 62 extends from the seat back 14 through an opening provided in adjusting lever 64 and through a hole 66 formed within the plate 60, and similarly through a hole 68 provided within the outer plate 58. The lever 64 is positioned within a groove 70 formed within the seat back 14. The aft end of the groove 70 is relieved to form a cut-out section 72. The lever 64 has attached thereto a pin 74 which extends through a hole 76 formed within the plate 60 and is capable of protruding outwardly from the plate 60 to connect with any one of the plurality of holes 78 formed within the plate 58. The plate 60 is fixedly secured by screw fastener 80 to the seat back 14. A washer 82 and a lock washer 84 cooperate together to be located about the free end of the shaft 62 to securely lock in place the plate 58 adjacent to the plate 60.

By manually pressing inwardly (toward the seat back 14) the handle 86 of the lever 64, which causes the lever to move into the cut out section 72, it causes the pin 74 to become disengaged from its appropriate hole 78. This in turn permits the arm 54 to be pivoted about the shaft 62. This pivoting motion can be anywhere from the retracted/non-used position shown within FIG. 18 to the used/extended position, such as shown within FIG. 1. When the desired arm position has been achieved, the operator merely releases a handle 86 which causes the pin 74 to engage with one of the openings 78 thereby fixing the arm.

Fixedly secured to the cylinder 36 and located about piston rod 34 is a collar 88. The exterior surface of the collar 88 includes a series of depressions 90 which are formed into a track. Located about the collar 88 in a close fitting manner, but rotatable in respect thereto, is a sleeve 92. The sleeve 92 is integrally formed with a first arm 94. First arm 94 includes an elongated slot 96. Actually, it is to be understood that a configuration of the arm 94 is that of a channel there will actually be two in number of the slots 96, one slot 96 in each side of the channel.

A pin 98 is to be slidably located pivotable within the slot 96. Pin 98 is secured to a second arm 100. The arm 100 is also channel shaped and is to engage with the first arm 94 in a telescoping manner.

A hole 102 is formed within the sleeve 92. A cap 104 is to be threadably engaged within the hole 102. Located within the cap 104 is a spring 106. A ball 108 is to be mounted on the spring 106. The ball is to be in continuous engagement with the track formed by depressions 90.

As the arm 94 is pivoted with respect to the collar 88, the ball 108 slides from depression 90 to another depression 90 within the track. The function of the ball 108 is that when the arm 94 is positioned where desired, that it will then have a tendency to remain in that established position until it is manually moved to another position.

The outer end of the arm 100 has attached thereto a rod 110. The rod 110 is to be fixedly connected to a mounting bracket 128. The mounting bracket 128 is fixedly attached to the underside of the tray 118. The tray 118 is divided into two compartments, 120 and 122. The compartments 120 and 122 are divided by a divider wall 124.

Figure 8:
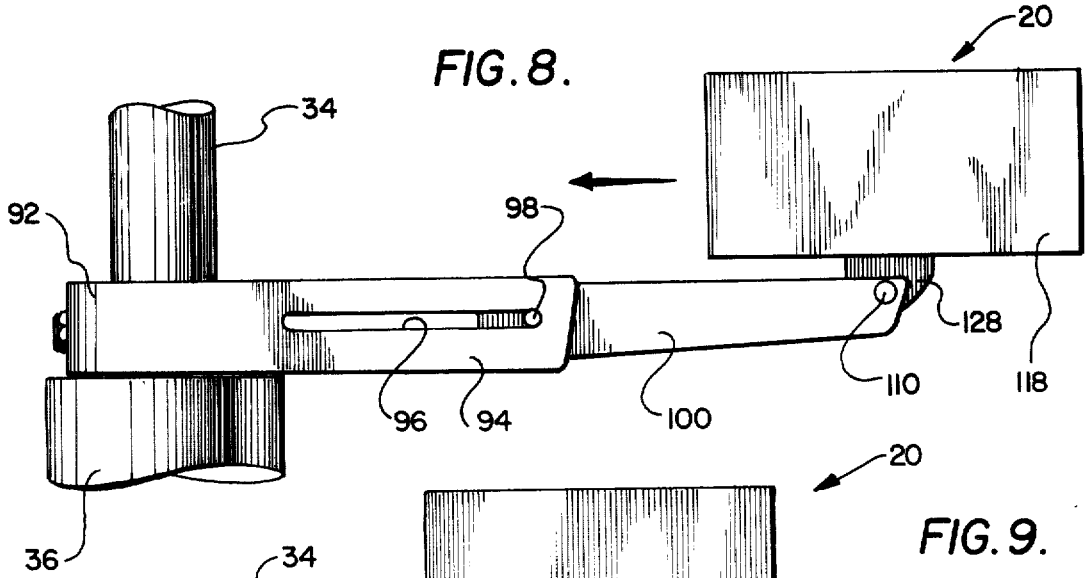
FIG. 8 is a side, elevational view of the tray and supporting arm assembly showing the tray in the extended/usable position.
Figure 9:
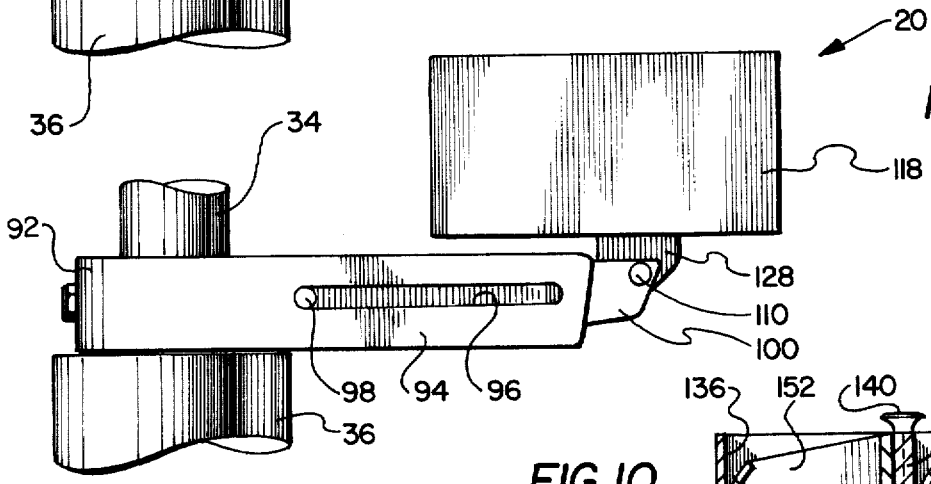
FIG. 9 is a view similar to FIG. 8, but showing the tray in a partially retracted state.

It is to be understood that the tray 118 can move between the retracted position shown in FIG. 9 to the extended position shown in FIG. 8. The tray 118 is not movable with respect to the arm 100, since there is a fixed connection between the rod 110 and the mounting bracket 128.

Referring particularly to FIGS. 10–12, 17 and 18, there is shown a second embodiment of tray assembly 130 wherein the tray 132 is similarly divided into compartments 134 and 136. Compartments 134 and 136 are separated by a divider wall 138. Centrally, longitudinally disposed within the divider wall 138 is a hole within which is slidingly located a rod 126. The outer end of the rod 126 has attached thereto a knob 140 to facilitate manual grasping and movement of the rod 126 against the action of coil spring 142 located within recessed area 144. The outer end of the coil spring 142 abuts washer 146 which is fixedly attached onto the rod 126.

The free end of the rod 126 is capable of cooperating within either recess 112 or 114 of a rod 148. Rod 148 is fixedly mounted through the channel shaped opening to the arm 150. The underside of the tray 132 is fixedly attached to a mounting bracket 116. Mounting bracket 116 is pivotally mounted on the rod 148.

Located within the compartment 136 is a drawer 152. Drawer 152 is to be pivotally mounted with respect to the tray 132. A similar drawer 154 is pivotally mounted with respect to the tray 132 and located within the compartment 134.

Figure 10:
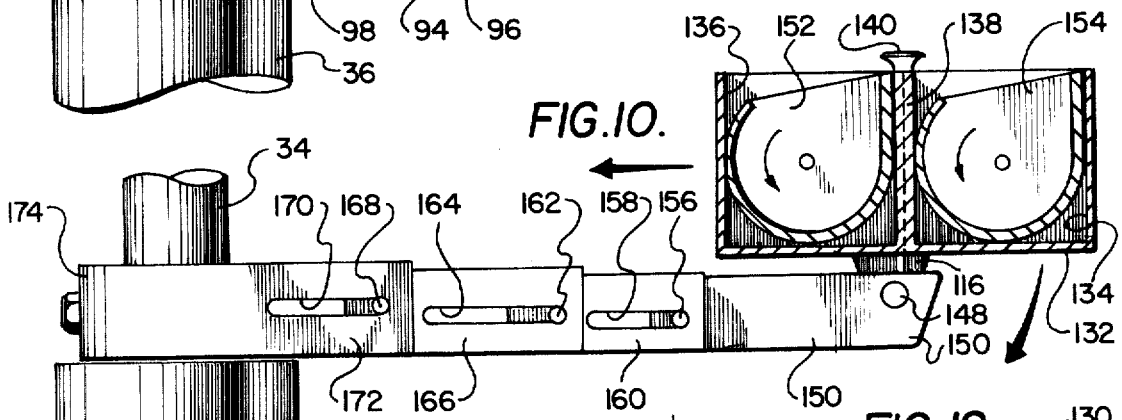
FIG. 10 is a partly in cross-sectional view similar to FIG. 8, but of a second embodiment of tray assembly of this invention.
Figure 11:
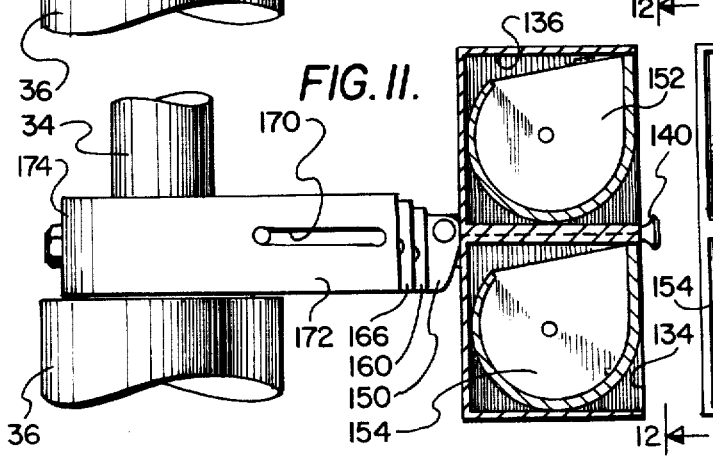
FIG. 11 is a view similar to FIG. 9, but partly in cross-section and of the second embodiment of tray assembly of this invention.
Figure 12:
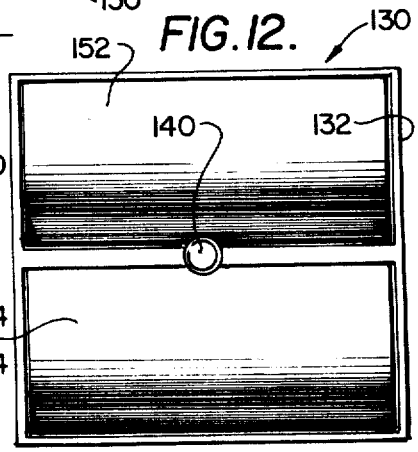
FIG. 12 is a view taken along line 12—12 of FIG. 11.

When the tray is in the position shown within FIG. 10, the rod 126 engages with recess 112 and access into each of the drawers 152 and 154 is permitted. However, the tray 132 can be pivoted ninety degrees to an upright position shown within FIG. 11. In this particular position, the knob 140 is grasped and an outward pulling movement is exerted against the rod 126 which compresses the coil spring 142 to disengage the rod 126 from the recess 112. The tray 132 is to then be pivoted until the rod 126 engages with recess 114. At this particular time, each of the drawers 152 and 154 have pivoted with respect to the tray 132 and access into the drawers 152 and 154 is no longer permitted. This position of the drawers 152 and 154 is what is termed to be the stowed position.

The arm 150 is connected to a pin 156. The pin 156 engages with a pair of slots 158 within a second arm 160. Similarly, the second arm 160 is attached to a pin 162 which in turn engages with a pair of slots 164 of a third arm 166. The third arm 166 is attached to a pin 168, which in turn rides within slots 170 of a fourth arm 172. The arm 172 is integrally attached to a sleeve 174 which is the full equivalent of sleeve 92. It is to be noted that there are four in number of the telescoping arms within the telescoping arm assembly of the second embodiment of this invention, where within the first embodiment, there are only two telescoping arm members.

What is claimed is:

1. A hairdresser chair comprising:

a stanchion assembly;

a base, said stanchion assembly being mounted on said base;

a seat mounted on said stanchion assembly, said seat having a substantially planar seating surface and bottom surface;

a back connected by connecting means to said seat, said back having a substantially planar front surface, said front surface being substantially perpendicular to said seating surface;

a pair of spaced-apart arms being attached to said back, each of said arms being individually pivotally connected to said back, each said arm being movable between an extended position and a retracted position, said retracted position being when a said arm is totally located against said back, said extended position is when a said arm extends outwardly from said front surface;

a tray assembly being pivotally mounted on said stanchion assembly, said tray assembly being located directly adjacent said bottom surface, said tray being pivotally attached to said arm assembly for movement between a usable position and a storage position, said storage position not permitting access to any contents contained within said tray; and said tray includes at least one article supporting drawer, said drawer being pivotally mounted within said tray, movement of said tray to said storage position causes said drawer to pivot in respect to said tray thereby not permitting access into said drawer.

2. A hairdresser chair comprising:

a stanchion assembly;

a base, said stanchion assembly being mounted on said base;

a seat mounted on said stanchion assembly, said seat having a substantially planar seating surface and bottom surface;

a back connected by connecting means to said seat, said back having a substantially planar front surface, said front surface being substantially perpendicular to said seating surface;

a pair of spaced-apart arms being attached to said back, each of said arms being individually pivotally connected to said back, each said arm being movable between an extended position and a retracted position, said retracted position being when a said arm is totally located against said back, said extended position is when a said arm extends outwardly from said front surface;

a tray assembly being pivotally mounted on said stanchion assembly, said tray assembly being located directly adjacent said bottom surface, said tray assembly being pivotally connected to said stanchion assembly through a pivot means, said pivot means including a detent means, said detent means to permit locating of said tray assembly in either one of a plurality of different positions and remain fixed in that position, said tray assembly being movable about three hundred and sixty degrees in respect to said stanchion assembly said tray assembly including a telescoping supporting arm assembly and a tray, the inner end of said telescoping arm assembly being connected to said stanchion assembly and the outer end of said telescoping arm assembly being attached to said tray, said tray to be movable between a retracted position located directly adjacent said stanchion assembly to an extended position being spaced some distance from said stanchion assembly, said tray being pivotally attached to said arm assembly for movement between a usable position and a storage position, said storage position not permitting access to any contents contained within said tray; and said tray includes at least one article supporting drawer, said drawer being pivotally mounted within said tray, movement of said tray to said storage position causes said drawer to pivot in respect to said tray thereby not permitting access into said drawer.

* * * * *